US012584232B2

(12) United States Patent
Xue et al.

(10) Patent No.: US 12,584,232 B2
(45) Date of Patent: Mar. 24, 2026

(54) METHOD FOR EXTRACTING PALLADIUM

(71) Applicant: INSTITUTE OF PROCESS ENGINEERING, CHINESE ACADEMY OF SCIENCES, Beijing (CN)

(72) Inventors: Tianyan Xue, Beijing (CN); Zhanpeng Yan, Beijing (CN); Hui Zhang, Beijing (CN); Ying Yu, Beijing (CN); Tao Qi, Beijing (CN); Minghui Liu, Beijing (CN)

(73) Assignee: INSTITUTE OF PROCESS ENGINEERING, CHINESE ACADEMY OF SCIENCES, Beijing (CN)

( * ) Notice: Subject to any disclaimer, the term of this patent is extended or adjusted under 35 U.S.C. 154(b) by 521 days.

(21) Appl. No.: 18/089,539

(22) Filed: Dec. 27, 2022

(65) Prior Publication Data

US 2023/0203688 A1 Jun. 29, 2023

(30) Foreign Application Priority Data

Dec. 27, 2021 (CN) ..... 202111615955.4

(51) Int. Cl.

| | |
|---|---|
| ***C25C 1/00*** | (2006.01) |
| ***C25C 1/20*** | (2006.01) |
| ***C25C 7/06*** | (2006.01) |

(52) U.S. Cl.

CPC . *C25C 1/20* (2013.01); *C25C 7/06* (2013.01)

(58) Field of Classification Search

CPC .. C22B 11/00; C22B 7/00; C25C 1/00; C25C 1/20; C25C 7/06

See application file for complete search history.

(56) References Cited

U.S. PATENT DOCUMENTS

2018/0312985 A1* 11/2018 Moskovchenko ..... C01G 5/00
2019/0256948 A1* 8/2019 Lubomirsky ..... C22B 11/026

FOREIGN PATENT DOCUMENTS

CN 108285978 A 7/2018
CN 109957659 A 7/2019

* cited by examiner

*Primary Examiner* — Zulmariam Mendez
(74) *Attorney, Agent, or Firm* — Bayramoglu Law Offices LLC

(57) ABSTRACT

A method for extracting palladium includes: (1) mixing a palladium-containing material with nitric acid and an alkali metal ion-containing catalyst to obtain a mixed solution, heating the mixed solution, and removing a resulting residue to obtain a palladium-containing leaching liquor; and (2) subjecting the palladium-containing leaching liquor obtained in step (1) to separative extraction to obtain metallic palladium or at least one palladium-containing product, and reusing a residual solution for step (1) in a subsequent extraction. The alkali metal ion-containing catalyst of the present disclosure can leach palladium at a higher rate than that when pure nitric acid of the same concentration is used and does not volatilize, such that the recycling of a mother liquor can be realized. The method involves simple operations, has low production costs, greatly shortens the palladium extraction time, does not lead to secondary pollution, and meets the requirements of environmental protection.

15 Claims, No Drawings

METHOD FOR EXTRACTING PALLADIUM

CROSS REFERENCE TO THE RELATED APPLICATIONS

This application is based upon and claims priority to Chinese Patent Application No. 202111615955.4 filed on Dec. 27, 2021, the entire contents of which are incorporated herein by reference.

TECHNICAL FIELD

The present disclosure belongs to the technical field of hydrometallurgy and specifically relates to a production technique for the wet extraction of palladium and in particular to a method for extracting palladium.

BACKGROUND

Palladium is a platinum-group metal (PGM) that has excellent plasticity, stability, and catalytic activity and is widely used in aerospace, nuclear energy, electronics, catalysts, and the like. Palladium is also regarded as a strategic reserve metal due to its uniqueness and scarcity. With the development of the global economy, the global demand for palladium is increasing, but the global reserves of palladium ore are very rare. Primary palladium ore has a relatively low palladium content and a high palladium extraction cost. Compared with a primary palladium ore phase, a palladium-containing secondary resource has a high enrichment degree, a low impurity content, and relatively easy palladium recovery. Therefore, the recovery of palladium from a palladium-containing secondary resource has important strategic significance and high economic value.

Palladium has stable chemical properties, is slightly soluble in dilute nitric acid and hydrochloric acid, and is insoluble in sulfuric acid. During industrial production, hot concentrated nitric acid or aqua regia (nitric acid:hydrochloric acid=1:3) is commonly used for the dissolution of palladium. However, when concentrated nitric acid is used, a large amount of nitrogen oxide is produced during a violent reaction process because concentrated nitric acid is highly volatile. Also, when aqua regia is used, the corresponding equipment needs to have high anti-corrosion resistance because aqua regia is strongly corrosive, and a large amount of toxic gas is produced during the reaction process, which fails to meet the requirements of environmental protection. In recent years, researchers have been committed to finding an alternative solvent as a replacement for concentrated nitric acid or aqua regia.

CN109957659A discloses a method for recovering palladium from a palladium-containing spent catalyst, and the method includes the following steps: (1) The palladium-containing spent catalyst is added to water and boiled 5 to 7 times at 90° C. to 100° C. for 1 h to 2 h each time, and the resulting solid is taken out. (2) The solid obtained in step (1) is added to a 1% to 3% alkali liquor and boiled 2 to 4 times at 85° C. to 95° C. for 1 h to 2 h each time. (3) After the alkali-boiling is complete, the pH of the resulting system is adjusted with sulfuric acid to 1 to 3. Subsequently, 4 to 6 mol/L hydrochloric acid and a specified amount of an oxidant such as sodium chlorate or chlorine are added, and leaching is conducted at 60° C. to 80° C. for 2 h to 3 h to obtain a palladium-containing organic precipitate. The method has high palladium recovery efficiency and low energy consumption but involves complicated palladium extraction steps, high water consumption, and high hydrochloric acid consumption, and the highly-corrosive and toxic chlorine and sodium chlorate are harmful to the environment.

CN108285978A discloses a method for recovering palladium from a palladium-containing catalyst. An organic matter in the palladium-containing catalyst is removed through low-temperature distillation (150° C. to 350° C.). Palladium is oxidatively leached with $H_2O_2$ in an HCl+NaCl solution to obtain a palladium-containing leaching liquor, and the palladium-containing leaching liquor is subjected to reduction with formic acid to obtain elemental palladium. The method has high palladium leaching efficiency but consumes a large amount of hydrochloric acid and hydrogen peroxide during the reaction process and leads to the production of highly volatile and toxic chlorine, which heavily pollutes the environment.

Given the problems of the above methods, it is urgent to develop an environmentally-friendly, economical, and efficient method for extracting palladium.

SUMMARY

To solve the above technical problems, the present disclosure provides a method for extracting palladium. The method involves a small acid consumption, a simple composition, a low production cost, and a recyclable leaching system. In addition, the method reduces the acid consumption from the source, reduces the introduction of impurity ions, improves the atom utilization, leads to no waste liquid, exhibits high leaching efficiency and high leaching rate during palladium extraction, and has promising industrial application prospects.

To achieve the above technical effects, the present disclosure adopts the following technical solutions:

The present disclosure provides a method for extracting palladium, including the following steps:

(1) A palladium-containing material is mixed with nitric acid and an alkali metal ion-containing catalyst to obtain a mixed solution. The mixed solution is heated to allow a reaction, and the resulting residue is removed to obtain a palladium-containing leaching liquor.

(2) The palladium-containing leaching liquor obtained in step (1) is subjected to separative extraction to obtain metallic palladium or at least one palladium-containing product, and the resulting residue can be reused for step (1).

In the present disclosure, the alkali metal ion-containing catalyst can accelerate a leaching reaction of palladium and does not volatilize itself, such that the recycling of a mother liquor can be achieved. The alkali metal ion-containing catalyst and the palladium-containing material are heated in nitric acid, a leaching liquor is subjected to separative extraction to obtain metallic palladium or at least one palladium-containing product, and a residual solution can be reused for step (1). A mixture of the alkali metal ion-containing catalyst and nitric acid is used instead of concentrated nitric acid or aqua regia to subject the palladium-containing material to leaching, which greatly reduces the acid consumption and the introduction of impurity ions, avoids the problem that reactants such as chloride ions, chlorine, and hydrogen peroxide are volatilized and decomposed in the traditional recovery process and thus cannot be recycled, greatly reduces the production cost and waste liquid emission, and meets the requirements of environmental protection. These advantages demonstrate innovation that distinguishes the present disclosure from the existing method.

As a preferred technical solution of the present disclosure, in step (1), an alkali metal ion includes any one selected from the group consisting of $Li^+$, $Na^+$, and $K^+$ and is preferably $Li^+$.

In the present disclosure, the use of a $Li^+$, $Na^+$, or $K^+$ ion as a catalyst can significantly increase the leaching rate of palladium.

In the present disclosure, the alkali metal ion-containing catalyst in step (1) may be lithium nitrate, lithium sulfate, lithium chloride, sodium nitrate, sodium sulfate, sodium chloride, potassium nitrate, potassium sulfate, potassium chloride, lithium carbonate, potassium carbonate, sodium carbonate, or another alkali metal ion-containing compound or solution.

As a preferred technical solution of the present disclosure, in step (1), a concentration of the alkali metal ion in the mixed solution is higher than or equal to 1 mol/L, such as 1 mol/L, 1.5 mol/L, 2 mol/L, 2.5 mol/L, 3 mol/L, 4 mol/L, 5 mol/L, 6 mol/L, or 7 mol/L, but the concentration is not limited to the listed values, and any other values in the range that are not listed are also applicable. The concentration is preferably higher than or equal to 5 mol/L.

As a preferred technical solution of the present disclosure, in step (1), the palladium content in the palladium-containing material is higher than or equal to 100 ppm, such as 100 ppm, 120 ppm, 140 ppm, 160 ppm, 180 ppm, 200 ppm, 300 ppm, or 1,000 ppm, and the palladium-containing material may even be pure palladium. The palladium content is not limited to the listed values, and any other values in the range that are not listed are also applicable.

In the present disclosure, in step (1), the palladium-containing material includes any one or a combination of at least two selected from the group consisting of metallic palladium, a palladium alloy, a palladium compound, a palladium-containing mineral, and a palladium-containing secondary resource. Typical, but non-limiting examples for the combination, are as follows: a combination of a palladium powder and a palladium-containing mineral, a combination of a palladium-containing mineral and a palladium-containing secondary resource, or a combination of a palladium-containing secondary resource and a palladium powder.

As a preferred technical solution of the present disclosure, in step (1), a hydrogen ion concentration in the mixed solution is higher than or equal to 1 mol/L, such as 1 mol/L, 2 mol/L, 3 mol/L, 4 mol/L, 5 mol/L, 6 mol/L, or 7 mol/L, but the concentration is not limited to the listed values, and any other values in the range that are not listed are also applicable.

In the present disclosure, in step (1), the ratio of various materials is not limited and can be adjusted according to the actual situation and needs.

As a preferred technical solution of the present disclosure, in step (1), the reaction is conducted at a temperature higher than or equal to 40° C., such as 40° C., 50° C., 60° C., 70° C., 80° C., or 90° C., but the temperature is not limited to the listed values, and any other values in the range that are not listed are also applicable. The temperature is preferably higher than or equal to 60° C.

As a preferred technical solution of the present disclosure, in step (2), a method for the separative extraction includes, but is not limited to, electrolysis, extractive separation, ion exchange, adsorption, or evaporative crystallization.

As a preferred technical solution of the present disclosure, in step (2), the method for the separative extraction is as follows: subjecting the palladium-containing leaching liquor obtained in step (1) to electrolysis such that metallic palladium is obtained at a cathode, and reusing a residual solution obtained after the electrolysis for step (1).

In the present disclosure, the extractive separation is conducted as follows: adding a specified amount of an extraction agent to the palladium-containing leaching liquor for extraction and conducting reverse extraction to obtain a relatively-pure palladium-containing compound solution and an alkali metal ion-containing raffinate. The extraction agent may be any one selected from the group consisting of diisoamyl sulfide (S201), sulfoxide, and hydroxyoxime but is not limited thereto.

In the present disclosure, the ion exchange and adsorption are conducted as follows: allowing the palladium-containing leaching liquor to pass through a device filled with an ion exchange resin or adsorbent, such that palladium is separated from a catalyst-containing mother liquor to obtain a palladium-containing compound product. The ion exchange resin includes any one selected from the group consisting of an isothiourea resin, a chelating piperidine resin (R410), and an extraction-elution resin, and the adsorbent may be activated carbon, copper powder, or the like. However, the ion exchange resin and the adsorbent are not limited to the above materials.

In the present disclosure, the evaporative crystallization is conducted as follows: heating the palladium-containing leaching liquor for evaporative crystallization to realize the separation of the catalyst and palladium to obtain a palladium-containing compound product. A method for evaporative crystallization includes rotary evaporation or MVR multiple-effect evaporation.

As a preferred technical solution for the present disclosure, the method includes the following steps:

(1) mixing a palladium-containing material having a palladium content of higher than or equal to 100 ppm with a catalyst including $Li^+$, $Na^+$, or $K^+$ (concentration: higher than or equal to 1 mol/L) and nitric acid having a hydrogen ion concentration of higher than or equal to 1 mol/L, heating to allow a reaction at a temperature of higher than or equal to 40° C., and removing a resulting residue to obtain a palladium-containing leaching liquor; and (2) subjecting the palladium-containing leaching liquor obtained in step (1) to separative extraction to obtain metallic palladium or at least one palladium-containing product, and reusing a residual solution for step (1) to realize the recycling of the mother liquor.

In the present disclosure, in step (2), the residual solution is reused for step (1) to realize the recycling of the mother liquor and reduce the waste liquid emission.

Compared with the prior art, the present disclosure has the following beneficial effects:

(1) The alkali metal ion-containing catalyst used in the present disclosure can accelerate a leaching reaction of palladium and does not volatilize itself, such that the recycling of a mother liquor can be achieved.

(2) Since a chlorine-containing compound is not being used as a catalyst, metallic palladium or a palladium compound without a chloride ion can be prepared in the present disclosure, using a simple process that produces high product quality with no production of toxic chlorine.

(3) The residual solution obtained after the separative extraction in the present disclosure can be recycled as a leaching agent by supplementing the nitric acid or can be used for the regeneration of nitric acid at an anode during the electrolysis of the leaching liquor, and no waste liquid is generated during the whole process.

DETAILED DESCRIPTION OF THE EMBODIMENTS

To facilitate the understanding of the present disclosure, some examples of the present disclosure are listed below. Those skilled in the art should understand that these examples help to explain the present disclosure and should not be regarded as specific limitations to the present disclosure.

Example 1

In this example, a method for extracting palladium is provided, including the following steps:

(1) 79 g of a palladium powder (palladium content: 95%) was mixed with a solution including 1.5 mol/L lithium nitrate and 6 mol/L nitric acid. The resulting mixture was heated to allow leaching at 80° C. The resulting residue was removed to obtain a palladium-containing leaching liquor.

(2) The palladium-containing leaching liquor obtained in step (1) was subjected to evaporative concentration for crystallization. The resulting crystal was separated to obtain a palladium nitrate product. The residual mother liquor was reused for step (1).

Example 2

In this example, a method for extracting palladium is provided, including the following steps:

(1) 3.5 g of a palladium powder (palladium content: 87%) and 0.16 mol of a lithium carbonate solid were mixed to obtain a resulting solution. Nitric acid was added to adjust the $H^+$ concentration of the resulting solution to 1 mol/L and a $Li^+$ concentration to 1 mol/L. The resulting mixture was heated to allow leaching at 80° C., and the resulting residue was removed to obtain a palladium-containing leaching liquor.

(2) The palladium-containing leaching liquor obtained in step (1) was subjected to electrolysis with a current density of 100 $A/m^2$ to obtain pure metallic palladium, and the residual solution obtained after the electrolysis was reused for step (1).

Example 3

In this example, a method for extracting palladium was provided, including the following steps:

(1) 100 g of anode sludge with a palladium content of 100 ppm was mixed with a solution including 7 mol/L sodium nitrate and 1.3 mol/L nitric acid. The resulting mixture was heated to allow leaching at 60° C., and the resulting residue was removed to obtain a palladium-containing leaching liquor.

(2) The palladium-containing leaching liquor obtained in step (1) was subjected to adsorption replacement with a copper powder to obtain a metallic palladium precipitate, and the residual solution was reused for step (1).

Example 4

In this example, a method for extracting palladium was provided, including the following steps:

(1) 3.8 g of a palladium powder (palladium content: 99.95%) was mixed with a solution including 5 mol/L potassium nitrate, 1 mol/L lithium nitrate, and 1.0 mol/L nitric acid. The resulting mixture was heated to allow leaching at 40° C., and the resulting residue was removed to obtain a palladium-containing leaching liquor.

(2) The palladium-containing leaching liquor obtained in step (1) was subjected to electrolysis with a current density of 500 $A/m^2$ to obtain a palladium sponge. Nitric acid was added to the residual solution obtained after the electrolysis, and the resulting solution was reused for step (1).

Example 5

In this example, a method for extracting palladium was provided, including the following steps:

(1) 150 g of an aluminum oxide-palladium catalyst with 0.3% of palladium was mixed with a solution including 6 mol/L lithium nitrate and 1.5 mol/L nitric acid. The resulting mixture was heated to allow leaching at 50° C., and the resulting residue was removed to obtain a palladium-containing leaching liquor.

(2) Diisoamyl sulfide (S201) was added to the palladium-containing leaching liquor obtained in step (1) for extraction. The raffinate was reused for step (1), and the resulting organic phase was subjected to reverse extraction to obtain a palladium nitrate product.

Example 6

In this example, a method for extracting palladium was provided, including the following steps:

(1) 100 g of an aluminum oxide-palladium catalyst with 0.5% of palladium was mixed with a solution including 6 mol/L sodium nitrate and 1.8 mol/L nitric acid. The resulting mixture was heated to allow leaching at 60° C., and the resulting residue was removed to obtain a palladium-containing leaching liquor.

(2) The palladium-containing leaching liquor obtained in step (1) was allowed to pass through a chelating piperidine resin (R410) adsorption column. The adsorption column was then washed with dilute hydrochloric acid and subjected to elution with thiourea to obtain a highly-pure palladium salt product, and the residual solution was reused for step (1).

Example 7

This example was different from Example 6 only in that, in step (2), activated carbon was used to adsorb palladium in the leaching liquor, and the resulting product was washed and dried to obtain a palladium-carbon composite.

Example 8

In this example, a method for extracting palladium was provided, including the following steps:

(1) 1.04 g of a palladium powder (palladium content: 99.95%) was mixed with a solution including 6 mol/L lithium nitrate and 1 mol/L nitric acid, the resulting mixture was heated to allow leaching at 80° C., and the resulting residue was removed to obtain a palladium-containing leaching liquor.

(2) The palladium-containing leaching liquor obtained in step (1) was subjected to electrolysis with a current density of 400 $A/m^2$ to obtain pure metallic palladium, and the residual solution obtained after the electrolysis was reused for step (1).

Example 9

This example was different from Example 8 only in that, in step (1), a concentration of lithium nitrate in the solution was 0.5 mol/L.

Example 10

This example was different from Example 8 only in that, in step (1), the leaching was conducted at 30° C.

Example 11

This example was different from Example 8 only in that, in step (1), a concentration of nitric acid in the solution was 0.5 mol/L.

Comparative Example 1

In this comparative example, a method for extracting palladium was provided, which was different from Example 8 only in that: in step (1), 1.04 g of a palladium powder (palladium content: 99.95%) was mixed with 7 mol/L nitric acid, the resulting mixture was heated to allow leaching at 80° C., and the resulting residue was removed to obtain a palladium-containing leaching liquor.

Comparative Example 2

In this comparative example, a method for extracting palladium was provided, which was different from Example 8 only in that: in step (1), 1.04 g of a palladium powder (palladium content: 99.95%) was mixed with a 7 mol/L lithium nitrate solution, the resulting mixture was heated to allow leaching at 80° C., and the resulting residue was removed to obtain a palladium-containing leaching liquor.

A concentration of palladium in the palladium-containing leaching liquor was determined by an inductively coupled plasma-atomic emission spectrometer (ICP-AES). A leaching time of 5 h was adopted in each of Examples 1 to 11 and Comparative Examples 1 and 2. Palladium leaching rates in Examples 1 to 11 and Comparative Examples 1 and 2 are shown in Table 1.

TABLE 1

| | Palladium leaching rate |
|---|---|
| Example 1 | 91.3% |
| Example 2 | 92.7% |
| Example 3 | 93.4% |
| Example 4 | 92.3% |
| Example 5 | 95.6% |
| Example 6 | 94.3% |
| Example 7 | 93.4% |
| Example 8 | 99.6% |
| Example 9 | 22.17% |
| Example 10 | 5.83% |
| Example 11 | 7.71% |
| Comparative Example 1 | 0.6% |
| Comparative Example 2 | Not leached |

It can be seen from Table 1 that, the method of the present disclosure can efficiently achieve the extraction of palladium. The palladium nitrate leaching rate in each of Examples 1 to 8 is higher than 91%. In the method for extracting palladium in Example 9, due to the low alkali metal ion concentration in the solution in step (1), the catalytic effect is poor, and thus a palladium nitrate leaching rate is decreased, which reduces the palladium recovery rate. In the method for extracting palladium in Example 10, due to a low leaching temperature in step (1), the leaching reaction is incomplete, which reduces the palladium nitrate leaching rate and palladium recovery rate. In the method for extracting palladium in Example 11, due to insufficient acidity in the solution in step (1), the oxidizing ability is weak, which reduces the palladium nitrate leaching rate and palladium recovery rate.

In Comparative Example 1, a system with 7 mol/L $HNO_3$ is used to leach palladium. After the heated leaching is conducted for 5 h, a palladium leaching rate is only 0.6%; the palladium leaching rate is very low and a large amount of a waste acid solution is produced.

In Example 8, the same amount of a solution including 6 mol/L lithium nitrate and 1 mol/L nitric acid and the same temperature are adopted, and after the heated leaching is conducted for 5 h, a palladium leaching rate is 99.6%, indicating that the addition of lithium ions plays a prominent catalytic role.

In Comparative Example 2, a system including 7 mol/L lithium nitrate is used to leach palladium. After the leaching is conducted for 5 h, the palladium still cannot be leached out, indicating that the acidic condition is a necessary condition for palladium leaching.

The above are merely specific implementations of the present disclosure, and the protection scope of the present disclosure is not limited thereto. Those skilled in the art should understand that any modification or replacement easily conceived by those skilled in the art within the technical scope of the present disclosure should fall within the protection scope and disclosure scope of the present disclosure.

What is claimed is:

1. A method for extracting a palladium, comprising the following steps:

(1) mixing a palladium-containing material with nitric acid and an alkali metal ion-containing catalyst to obtain a mixed solution, heating the mixed solution to allow a reaction, and removing a resulting residue to obtain a palladium-containing leaching liquor, wherein the alkali metal ion-containing catalyst is one or more selected from the group consisting of lithium nitrate, lithium sulfate, sodium nitrate, sodium sulfate, potassium nitrate, potassium sulfate, lithium carbonate, potassium carbonate, and sodium carbonate; and (2) subjecting the palladium-containing leaching liquor obtained in the step (1) to a separative extraction to obtain a metallic palladium or at least one palladium-containing product, and reusing a residual solution for the step (1).

2. The method according to claim 1, wherein in the step (1), a concentration of the alkali metal ion-containing catalyst in the mixed solution is higher than or equal to 1 mol/L.

3. The method according to claim 1, wherein in the step (1), the palladium-containing material has a palladium content of higher than or equal to 100 ppm.

4. The method according to claim 1, wherein in the step (1), the mixed solution has a hydrogen ion concentration of higher than or equal to 1 mol/L.

5. The method according to claim 1, wherein in the step (1), the reaction is conducted at a temperature higher than or equal to 40° C. and preferably higher than or equal to 60° C.

6. The method according to claim 1, wherein in the step (2), a method for the separative extraction comprises an electrolysis, an extractive separation, an ion exchange, an adsorption, or an evaporative crystallization.

7. The method according to claim 6, wherein in the step (2), the method for the separative extraction comprises: subjecting the palladium-containing leaching liquor obtained in the step (1) to the electrolysis, so the metallic palladium is obtained at a cathode; and reusing the residual solution obtained after the electrolysis for the step (1).

8. The method according to claim 1, comprising the following steps:

(1) mixing the palladium-containing material having a palladium content of higher than or equal to 100 ppm with a catalyst having a higher concentration than or equal to 1 mol/L and the nitric acid having a hydrogen ion concentration of higher than or equal to 1 mol/L, heating to allow the reaction at a temperature of higher than or equal to 40° C., and removing the resulting residue to obtain the palladium-containing leaching liquor; and (2) subjecting the palladium-containing leaching liquor obtained in the step (1) to the separative extraction to obtain the metallic palladium or the at least one palladium-containing product, and reusing the residual solution for the step (1) to realize a recycling of a mother liquor.

9. The method according to claim 1, wherein in the step (1), the alkali metal ion-containing catalyst is lithium nitrate, lithium sulfate or lithium carbonate.

10. The method according to claim 2, wherein in the step (1), the concentration of the alkali metal ion-containing catalyst in the mixed solution is higher than or equal to 5 mol/L.

11. The method according to claim 5, wherein the temperature is higher than or equal to 60° C.

12. The method according to claim 2, wherein in the step (1), the palladium-containing material has a palladium content of higher than or equal to 100 ppm.

13. The method according to claim 2, wherein in the step (1), the mixed solution has a hydrogen ion concentration of higher than or equal to 1 mol/L.

14. The method according to claim 3, wherein in the step (1), the mixed solution has a hydrogen ion concentration of higher than or equal to 1 mol/L.

15. The method according to claim 1, wherein in the step (1), the mixed solution has a hydrogen ion concentration equal to 1 mol/L.

* * * * *